US005769394A

United States Patent [19]

Yirmiyahu et al.

[11] Patent Number: 5,769,394

[45] Date of Patent: Jun. 23, 1998

[54] METHOD AND APPARATUS FOR FORCE-OPENING DOORS

[76] Inventors: Benyamin Yirmiyahu, 52 Maimon St., Bnei Brak; Mordechai Yirmiyahu, 17 Enzio Sereni St., Givatayim, both of Israel

[21] Appl. No.: 669,094

[22] Filed: Jun. 26, 1996

[51] Int. Cl.[6] ..... B66F 3/00

[52] U.S. Cl. ..... 254/93 R; 29/239; 254/1

[58] Field of Search ..... 29/239, 252; 254/93 R, 254/104, 133, DIG. 4, 1; 72/705, 407

[56] References Cited

U.S. PATENT DOCUMENTS 3,973,315 8/1996 Thanghe ..... 29/239

4,783,050 11/1988 Yirmiyahu et al. ..... 29/239

*Primary Examiner*—Robert C. Watson

*Attorney, Agent, or Firm*—Edward Langer

[57] ABSTRACT

A method and apparatus for force-opening doors, particularly effective with respect to steel doors and other types of solidly built doors. In a preferred embodiment, an anchoring unit carrying a ram unit having a ram member is aligned with a side of a door frame. The anchoring unit is anchored to the door by moving a pair of clamping members towards each other into clamping engagement with the opposite sides of the door. The clamping members are moved towards each other by a force-multiplying device, preferably a hydraulic device. Once anchored to the door, the ram member is driven outwardly of the ram unit by a force-multiplying device, against the side of the door frame to force-open the door. The ram unit includes an abutting member positionable to abut against the inside face of the door facing the ram unit, to assist in force-opening the door when the ram member is driven against the door frame.

8 Claims, 5 Drawing Sheets

METHOD AND APPARATUS FOR FORCE-OPENING DOORS

FIELD OF THE INVENTION

The present invention relates generally to safety and rescue equipment, and more particularly, to a method and apparatus for force-opening doors, particularly for use by fire departments, police departments, rescue squads, and the like, in order to break through a locked door.

BACKGROUND OF THE INVENTION

There are occasions where it is necessary, for example by the fire department, police department or a rescue squad, to force open a locked door. This is usually done by a brute-force technique, e.g., by using a battering ram or a sledge hammer, or by blasting away the lock by a firearm. However, the equipment needed, e.g., a battering ram, may not be conveniently available or may require a number of people to operate, or it may take a considerable period of time in order to force-open the door. Moreover, such a brute-force technique is usually accompanied by a loud noise which can be very disturbing.

In Israel patent Application 80536 by the present inventors, there is disclosed a device for force-opening doors wherein an anchoring unit is attached to the door frame, a ram unit is secured to the anchoring unit, and a ram member is projected outwardly of the ram unit to force-open the door. Such a technique has been found effective with respect to wooden doors, but less effective with respect to certain types of steel doors or other solidly built doors.

Therefore, it would be desirable to provide a method and apparatus for force-opening heavy-duty steel and other solidly built doors, in cases of emergency and rescue operations.

SUMMARY OF THE INVENTION

Accordingly, it is a principal object of the present invention to overcome the disadvantages of prior art devices which are ineffective in force-opening heavy-duty doors, and provide a method and apparatus for force-opening doors, particularly effective with respect to steel doors and other types of solidly built doors.

According to one aspect of the present invention, there is provided a method of force-opening a door hingedly mounted at a first side in a corresponding first side of a door frame, and secured at the opposite, second side in a closed position by a locking bolt received within a corresponding second side of the door frame, comprising:

anchoring to the door an anchoring unit carrying a ram unit having a ram member aligned with the second side of the door frame; and driving the ram member outwardly of the ram unit against the second side of the door frame to force-open the door.

According to further preferred features in the described embodiment, the anchoring unit is anchored to the door by moving a pair of clamping members towards each other into clamping engagement with the first and second sides of the door. The clamping members are moved towards each other by a force-multiplying device, preferably a hydraulic device.

According to still further features in the described embodiment, the ram member is driven outwardly of the ram unit by a force-multiplying device, also preferably a hydraulic device. Also, the ram unit includes an abutting member positionable to abut against the face of the door facing the ram member at the second side of the door, to assistin force-opening the door when the ram member is driven against the door frame.

According to another aspect of the invention, there is provided apparatus for force-opening a door hingedly mounted at a first side in a corresponding first side of a door frame, and secured at the opposite, second side in a closed position by a locking bolt received within a corresponding second side of the door frame, comprising:

an anchoring unit adapted to be anchored to the door;

a ram unit carried by the anchoring unit and including a ram member to be aligned with the second side of the door frame; and a drive for driving the ram member outwardly of the ram unit against the second side of the door frame to force open the door.

As will be described more particularly below, the foregoing method and apparatus have been found especially effective for force-opening steel doors or other types of doors of very solid (e.g., wood) construction.

Further features and advantages of the invention will be apparent from the drawings and the description contained herein.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
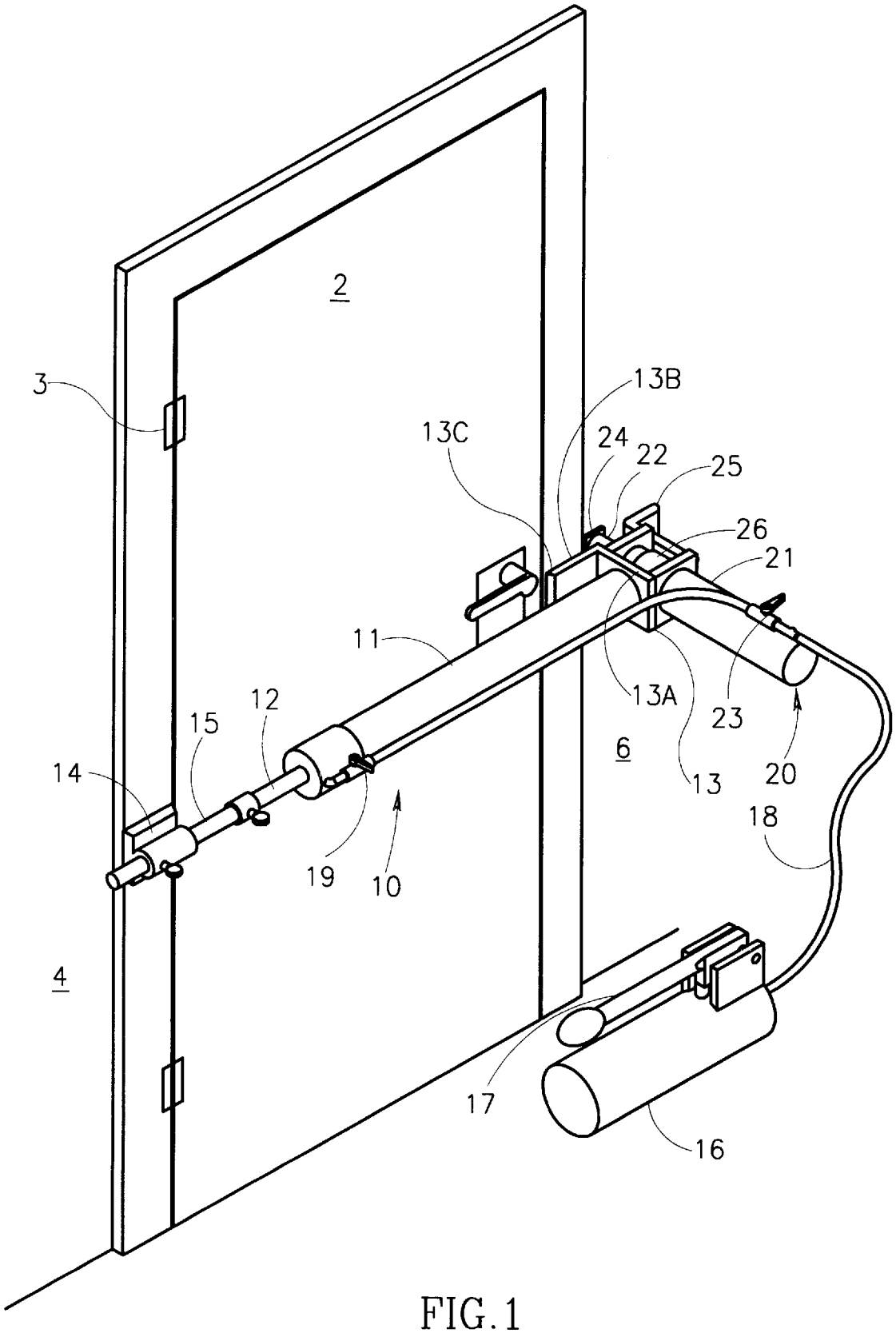
FIG. 1 is a front perspective illustrating an apparatus for force-opening doors in accordance with the present invention.
Figure 2:
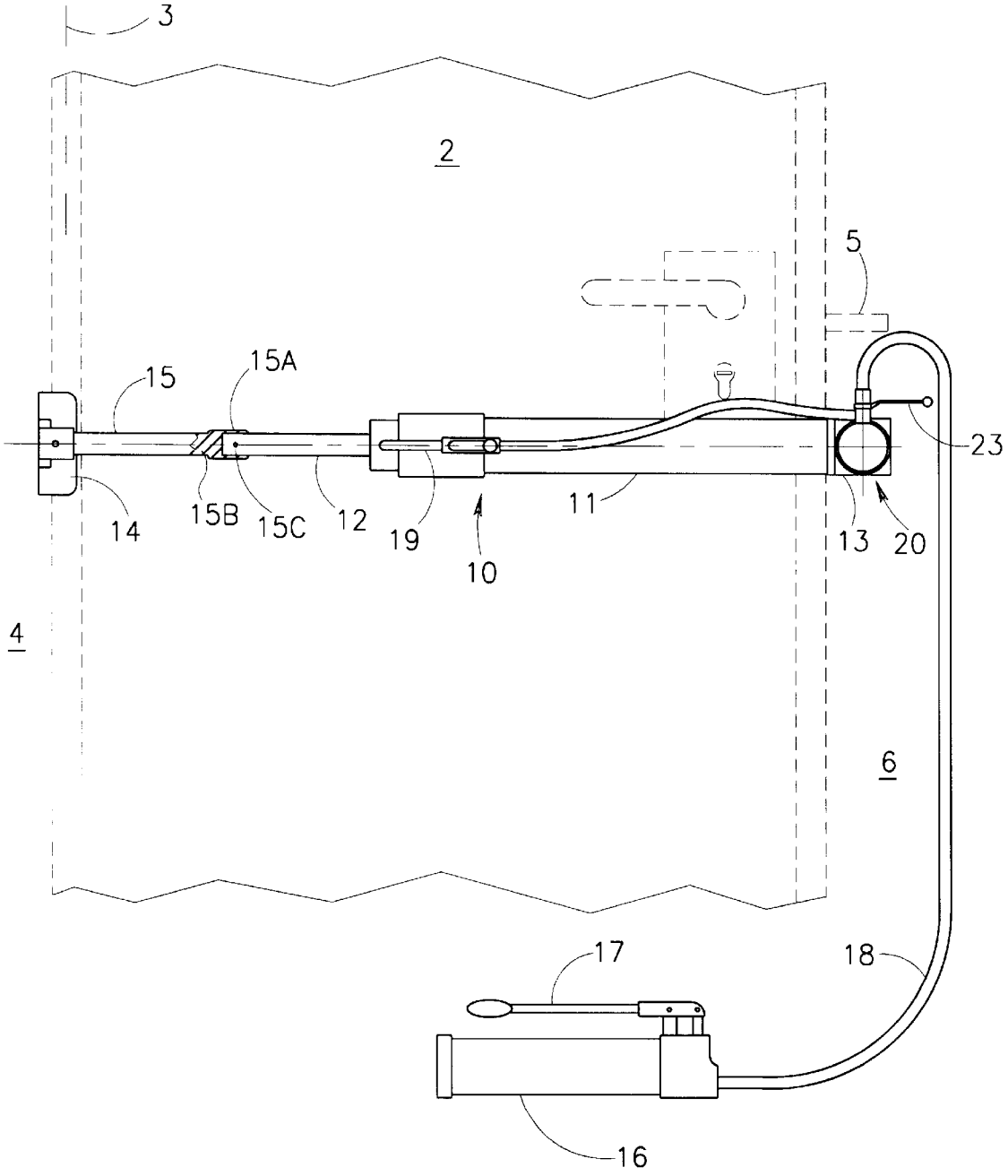
FIG. 2 is a front view illustrating one form of apparatus constructed in accordance with the present invention as applied to a door for force-opening it.

With reference to the drawings, in FIGS. 1–2 there is illustrated a door, generally designated 2, hingedly mounted by a hinge (shown schematically at 3) at one side of the door frame 4, and secured at the opposite side in a closed position by a locking bolt 5 (FIG. 2) received within an opening in the corresponding side 6 of the door frame.

The apparatus for force-opening the door, when so locked in the door frame, includes two basic units, namely: an anchoring unit generally designated 10; and a ram unit, generally designated 20, carried by the anchoring unit 10. As will be described more particularly below, the anchoring unit 10 is first anchored to the door 2 with the ram unit 20 aligned with side 6 of the door frame, and then the ram unit 20 is driven against side 6 of the door frame to force open the door.

The anchoring unit 10 comprises a hydraulic cylinder 11 and a piston rod 12 having a piston (not shown) movable within the cylinder. A first clamping member 13 is secured to one end of cylinder 11, e.g., by welding, and a second clamping member 14 is secured at the opposite end to extension member 15, fixed to the piston rod 12.

Figure 3:
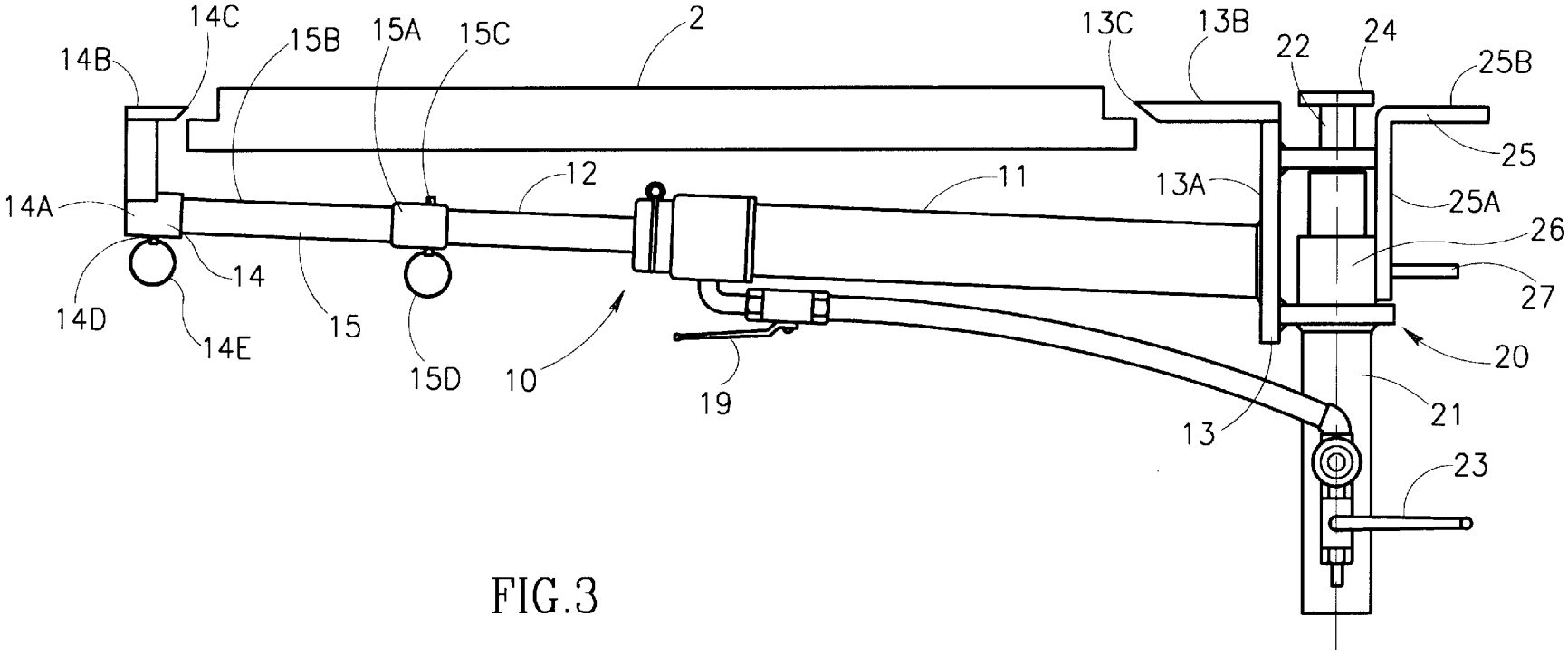
FIG. 3 is a plan view of the apparatus of FIGS. 1–2 in its initial non-anchoring position as applied to the door.

Clamping member 13 is of L-configuration. It includes a plate 13*a* (FIG. 3) extending substantially perpendicularly to cylinder 11, and a right-angle plate 13*b* extending perpendicularly to plate 13*a* and terminating in a tapered outer edge 13*c*. As illustrated, plate 13*a* is secured by welding to the end face of cylinder 11, which end face is inclined to form an angle slightly less than 90 degrees to the longitudinal axis of the cylinder.

The apparatus illustrated in the drawings may be varied in length to permit the apparatus to be applied to doors of different widths. For this purpose, clamping member 14 at door-hinge side of the apparatus is fixed to piston rod 12 via an extension member 15. Extension member 15 includes a section 15*a* at one end formed with a socket for receiving the end of piston rod 12, and with a rod section 15*b* at the opposite end having the same cross-section as piston rod 12. Extension member 15 is secured to the end of piston rod 12 by a pin 15*c* passing through aligned openings in socket section 15*a* and the respective end of the piston rod. Pin 15*c* is provided with a finger loop 15*d* for receiving the user's finger in order to facilitate the application and removal of pin 15*c*.

Clamping member 14 also includes a section 14*a* at one end formed with a socket for receiving either the rod section 15*b* of extension member 15, or the end of piston rod 12 where the clamping member is to be attached directly to the piston rod. Clamping member 14 further includes a right-angle plate 14*b* secured, by welding, to section 14*a* and formed with a tapered outer edge 14*c*, similar to plate 13*b* and tapered edge 13*c* of clamping member 13. Clamping member 14 is secured to extension member 15 by a pin 14*d* passing through aligned openings in socket section 14*a* of clamping member 14 and rod section 15*b* of extension member 15. Pin 14*c* also includes a finger loop 14*e* to facilitate the application and removal of the pin.

It will be appreciated that if the effective length of the anchoring unit 10 is to be reduced, for use in force-opening doors of smaller width, extension member 15 would not be used; instead clamping member 14 would be attached directly to the end of piston rod 12, received within socket section 14*a* of clamping member 14 and secured in place by pin 14*c*. It will also be appreciated that the effective length of the anchoring member may be further increased by providing a plurality of extension units 15, of the same or different lengths but otherwise constructed as described above with respect to extension unit 15, to be applied to the end of piston rod 12 between that rod and clamping member 14.

A hydraulic device, including a hydraulic reservoir 16 and a manual lever 17 is connected to cylinder 11 of the anchoring unit 10 by a tube 18 and a valve controlled by an operator 19. Lever 17 may be manually reciprocated by the user in order to pump oil from reservoir 16 into cylinder 11 to extend piston rod 12 or to retract it within the cylinder. Such hydraulic devices are well known, for example in hydraulic jacks, and therefore further details of the construction and operation of the hydraulic device are not set forth herein.

Ram unit 20 carried by the anchoring unit 10 also includes a hydraulic cylinder 21 and a piston rod 22 actuatable by the hydraulic device including reservoir 16 and manual lever 17, under the control of valve lever 23, to move piston rod 22 to a retracted or extended position with respect to the hydraulic cylinder 21. Piston rod 22 serves as a ram member which is aligned with side 6 of the door frame when the anchoring unit 10 has been applied to the door, and is driven to an extended position outwardly of the ram unit 20 against side 6 or the door frame to force-open the door. For this purpose, the end of piston rod 22, serving as the ram member, carries a plate 24 of relatively large surface area to be applied against side 6 of the door frame.

Figure 4:
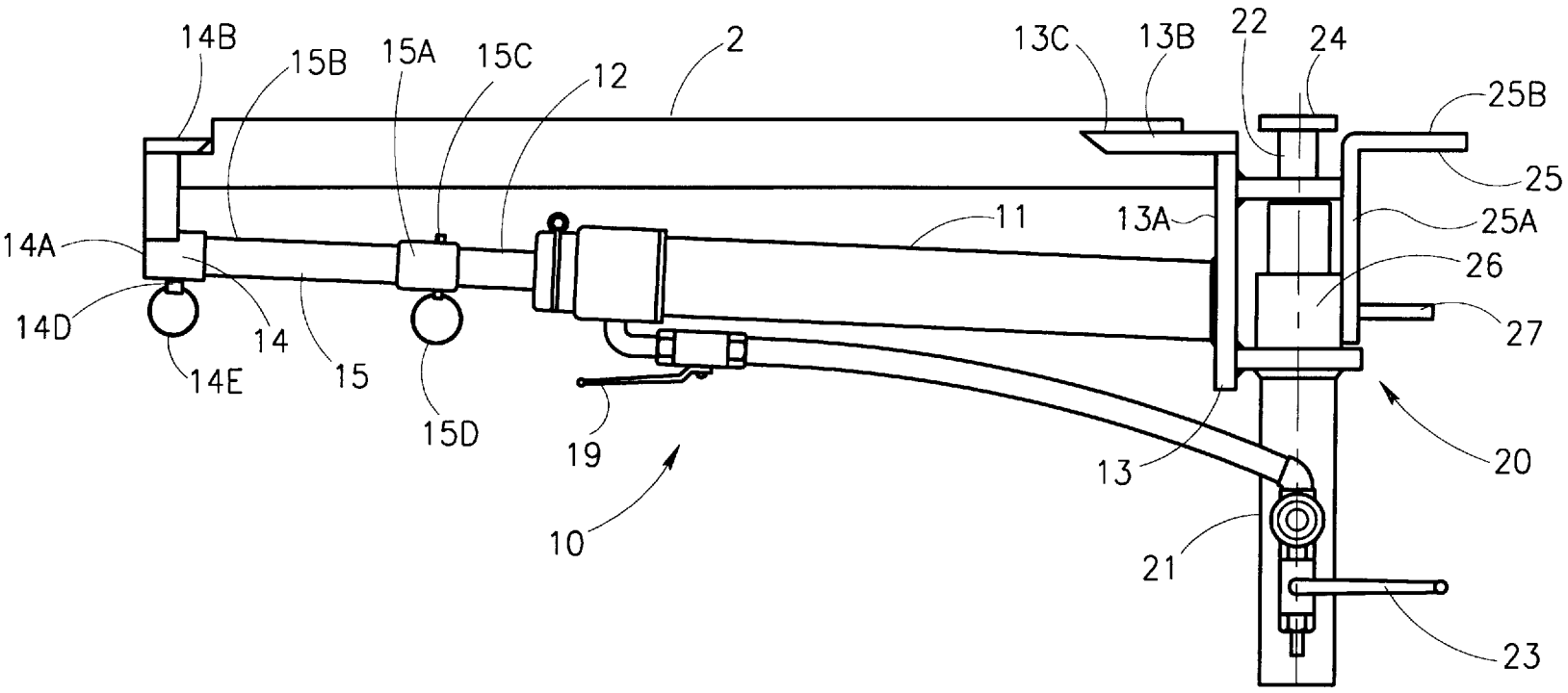
FIG. 4 is a plan view of the apparatus of FIGS. 1–2 in its operative position anchored to the door.
Figure 5:
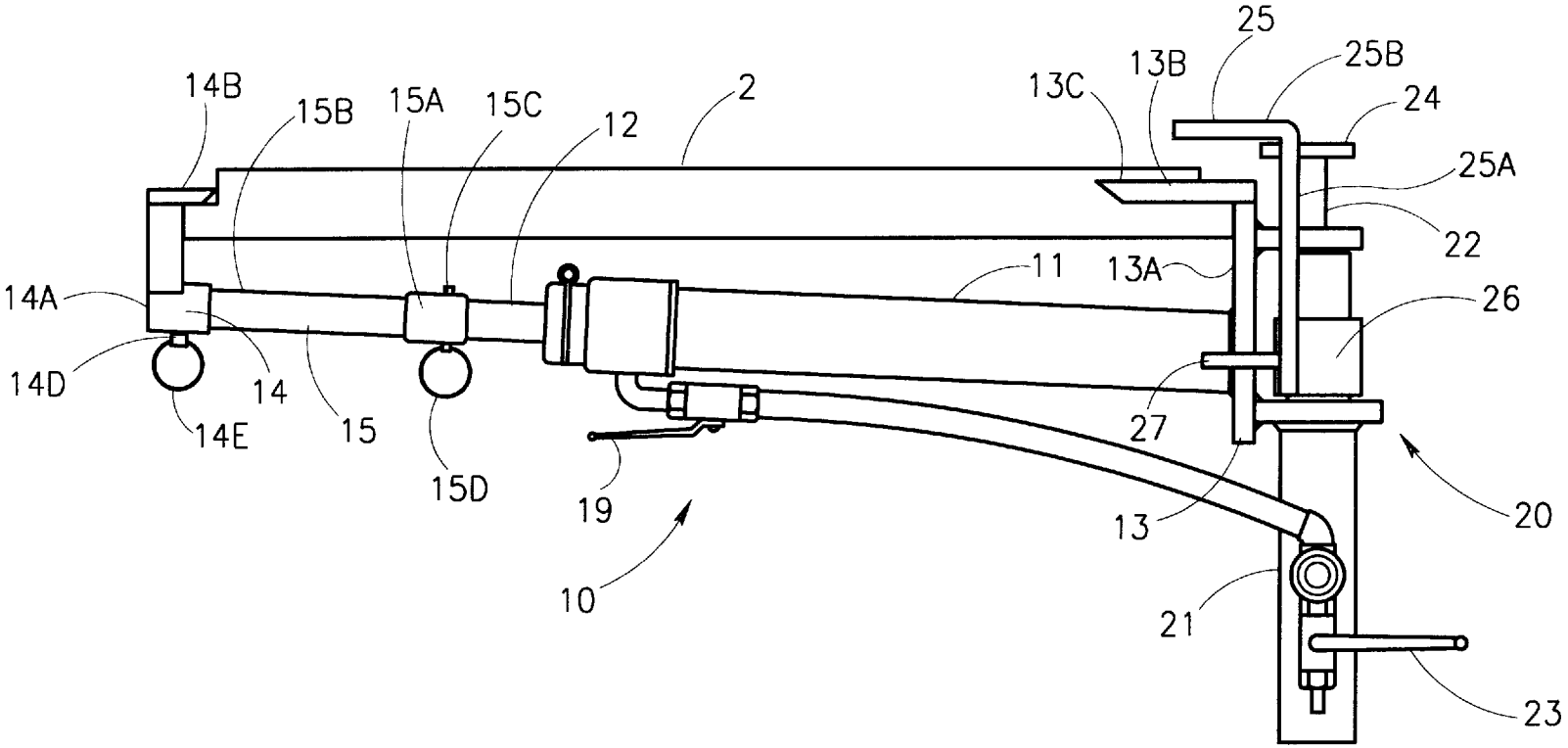
FIG. 5 is a view similar to that of FIG. 4 but illustrating the condition of the apparatus when an abutting member is used in order to assist the apparatus to force-open the door.

Ram unit 20 further includes an abutting member 25 which may be used, whenever needed, for aiding the force-opening of the door whenever desired. For this purpose, abutting member 25 is also of an L-configuration, including a bar 25*a* extending parallel to plate 13*a* of clamping member 13, and a right-angle bar 25*b* extending parallel to plate 13*b* of clamping member 13. Plate 25*a* is secured, as by welding, to a sleeve 26 rotatably received on the ram unit 20, enabling abutting member 25 to be pivotted by a handle 27 to either a non-operative position (FIGS. 3–4) or an operative position (FIG. 5).

The apparatus illustrated in the drawings is used in the following manner:

The anchoring unit 10 is first applied to the door by extending piston rod 12 with respect to its hydraulic cylinder 11, aligning the two clamping members 13 and 14 with the opposite sides of the door 2, moving valve lever 19 to its open position, and retracting piston rod 12 within cylinder 11 by operating manual handle 17 to cause the clamping plates 13*b* and 14*b* of the two clamping members to become firmly anchored to the door 2. The tapered edges 13*c*, 14*c* of clamping plate 13*b*, 14*b* causes the two plates to become firmly embedded within door 2 by a wedging action, and thus to firmly anchor the anchoring unit 10 to the door 2.

When the anchoring unit 10 is so anchored to the door 2, plate 24 of the ram unit 20 is aligned with side 6 of the door frame receiving the locking bolt 5 of the door. Preferably, the anchoring unit 10 is applied to the door 2 such that plate 24 of the ram unit 20 is spaced relatively close to the locking bolt 5, e.g., just above the locking bolt. Valve lever 19 of the anchoring unit is moved to its closed position, while valve lever 23 is moved to its open position. Manually operating lever 17 of the hydraulic reservoir 16 will therefore project rod 22 to apply a large force to plate 24 against side 6 of the door frame to break or bend the locking bolt 5, or to strip it from the hole in the door frame.

If the two clamping members 13 and 14 of the anchoring unit 10 are not, or cannot be, firmly anchored to the door, abutting member 25 may be used to assistin force-opening the door at the time the ram unit 20 is operated. Thus, as shown in FIG. 5, when abutting member 25 is to be used, it is pivotted from its non-operative position (shown in FIGS. 3–4) to its operative position (shown in FIG. 5), to align its bar 25*b* with the inside face of door 2. Abutting member 25 thereby aids plate 13*b* for applying a counter-force to door 2 when ram member 22 and its plate 24 of the ram unit 20 are driven to their extended positions in order to force-open the door.

It will be seen that both the anchoring unit 10 and the ram unit 20 are driven by a hydraulic force-multiplying device in order to anchor the apparatus to the door and to force-open the door. Other types of force-multiplying devices may be used, for example mechanical devices such as screws, ratchet mechanisms, and the like, e.g., as used in various types of mechanical jacks.

It will therefore be appreciated that the apparatus illustrated in the accompanying drawings is set forth merely for purposes of example and that many other variations, modifications and applications of the invention may be made.

Having described the invention with regard to certain specific embodiments thereof, it is to be understood that the description is not meant as a limitation, since further modifications will now become apparent to those skilled in the art, and it is intended to cover such modifications as fall within the scope of the appended claims.

We claim:

1. A method for force-opening a door by applying a pulling force thereto in the direction of opening, the door being hingedly mounted at a first side in a corresponding first side of a door frame, and secured at the opposite, second side in a closed position by a locking bolt received within a corresponding second side of the door frame, said method comprising the steps of:

anchoring to the door on edges of its face to be pulled open an anchoring unit carrying a ram unit having a ram member aligned with said second side of the door frame;

driving said ram member outwardly of said ram unit against said second side of the door frame to force-open the door by applying a pulling force thereto in the direction of opening.

2. The method according to claim 1, wherein said anchoring unit is anchored to the door by moving a pair of members towards each other into clamping engagement with said first and second sides of the door.

3. The method according to claim 2, wherein said clamping members are moved towards each other by a force multiplying device.

4. The method according to claim 3, wherein said force-multiplying device is a hydraulic device.

5. The method according to claim 1, wherein said ram member is driven outwardly of said ram unit by a force-multiplying device.

6. The method according to claim 5, wherein said latter force-multiplying device is a hydraulic device.

7. The method according to claim 1, wherein said ram unit includes an abutting member positionable to abut against the face of the door facing the ram member at said second side of the door, to assist in force-opening the door when the ram member is driven against the door frame.

8. The method according to claim 7, wherein said abutting member is pivotal on said ram unit to an operative position to abut against said face of the door for aiding in force-opening the door, or to a non-operative position laterally spaced from said door.

* * * * *